United States Patent [19]

Woodman et al.

[11] Patent Number: 4,753,026

[45] Date of Patent: Jun. 28, 1988

[54] SIGN AND SIGNAGE SYSTEMS

[75] Inventors: Michel A. G. Woodman; Kenneth W. A. Elcock, both of Ashford, England

[73] Assignee: Esselte Pendaflex Corporation, New York, N.Y.

[21] Appl. No.: 859,447

[22] Filed: May 5, 1986

Related U.S. Application Data

[63] Continuation of Ser. No. 506,445, Jun. 21, 1983, abandoned.

[51] Int. Cl.[4] ..... G09F 7/00

[52] U.S. Cl. ..... 40/584; 40/10 R; 40/618

[58] Field of Search ..... 40/618, 10 R, 605, 402, 40/16.4, 16, 607, 606

[56] References Cited

U.S. PATENT DOCUMENTS

| | | | |
|---|---|---|---|
| 1,755,758 | 4/1930 | Zimmerman | 40/16 R |
| 2,451,581 | 10/1948 | Slavsky et al. | 40/16.2 |
| 3,154,870 | 11/1964 | Hopp et al. | 40/16.4 |
| 3,162,965 | 12/1964 | Snediker | 40/10 R |
| 3,418,738 | 12/1968 | Goodman | 40/618 |
| 3,419,979 | 1/1969 | McIver et al. | 40/618 |
| 3,565,152 | 2/1971 | Cohn | 40/605 |
| 3,748,767 | 7/1973 | Giesecke | 40/16.4 |
| 3,877,163 | 4/1975 | Bissonet | 40/16.4 |
| 4,166,332 | 9/1979 | Donovan | 40/605 |
| 4,367,604 | 1/1983 | Porter et al. | 40/618 |
| 4,450,955 | 5/1984 | Featherstom | 40/16 R |

FOREIGN PATENT DOCUMENTS

| | | | |
|---|---|---|---|
| 1009406 | 5/1957 | Fed. Rep. of Germany . | |
| 1497698 | 9/1969 | Fed. Rep. of Germany . | |
| 2251000 | 5/1977 | Fed. Rep. of Germany . | |
| 1591381 | 4/1970 | France . | |
| 223669 | 12/1942 | Switzerland | 40/16 |
| 1288948 | 9/1972 | United Kingdom . | |
| 2034391 | 6/1980 | United Kingdom | 40/10 R |

*Primary Examiner*—Robert Peshock
*Assistant Examiner*—Wenceslao J. Contreras
*Attorney, Agent, or Firm*—Darby & Darby

[57] ABSTRACT

A sign unit is described which may be used in a variety of ways to make up signs. The unit consists of an extruded section having a flat central web (1, 30) and two flanges (2, 3, 32, 33). The outer surface of web (1) remote from the flanges can have a legend printed on it. Alternatively a sign plate (14, 15, 37, 38) may be inserted between flanges (2 and 3) and held against e.g. ribs (4) or in grooves (35, 36). The flanges or formations thereon may be dimensioned to cooperate with a holder on which the unit may be clipped. The sign unit is preferably made of aluminium alloy or rigid plastics material.

12 Claims, 12 Drawing Sheets

SIGN AND SIGNAGE SYSTEMS

This is a continuation of application Ser. No. 506,445 filed June 21, 1983 abandoned.

This invention relates to signs and signage systems, particularly for indoor use.

A wide variety of signs and signage systems has been developed for use in buildings. Many such systems are difficult to operate in practice due to the wide variety of mechanical support and fixing means and of sign panels which need to be used. In addition, many known signage systems are inflexible and do not lend themselves easily to change to reflect desired changes in signage, e.g. where it is desired to change one sign legend for another. Often the entire sign must be renewed and this gives rise to difficulties in practice.

A well-tried approach in interior signage is to provide some sort of frame member into which sign indicia may be inserted. Examples of this type of signage are described inter alia in British Patent Specifications Nos. 937,188; 951,870; 966,550; 969,500; 972,369; 1,404,801 and U.S. Pat. No. 4,334,372.

An alternative approach which has been adopted is to provide flat panels which can be clipped to a base and which can receive sign legends. Systems of this type are described in British Patent Specifications Nos. 1,532,995 and 2,034,391.

Many of these systems are dedicated to one particular type of legend display and are inflexible. We have now found that by careful design it is possible to produce signs and a signage system which is exceptionally versatile but which uses a relatively small number of basic components. The most fundamental component, which constitutes a first feature of the present invention, is an extruded section which can be used either way round in signage applications, as will be described in more detail below.

Thus in accordance with a first feature of the present invention there is provided a multi-purpose sign unit consisting of an extruded section formed of a flat central web and two flanges extending from the two edges thereof and both on the same side thereof, the extrusion having a generally elongated C-shape in cross-section, and wherein the flat outer surface of the web on the side opposite the flanges is adapted to receive a legend and wherein the section is characterised by formations on the facing surfaces of the two flanges which formations are adapted to receive a sign plate and hold it in a position parallel to and spaced from the central web.

A length cut from such an extruded section may be used in one of two main ways: first, a sign legend may be applied directly to the surface of the central web remote from the two flanges. The mode of application may vary widely, for example by printing, adhesion of vinyl film letters thereto or adhesion thereto of translucent film carrying thereunder or having printed thereon one or more legible indicia.

Alternatively, a sign sheet may be inserted between the two flanges and supported on the formations, the extrusion then constituting a frame for the sign sheet. Such a sign sheet may be for example a plastics sign sheet having a sign legend applied thereto. The invention is of particular value with so-called sub-surface signs consisting of a sheet of transparent or translucent plastics through which the legend is visible and right reading having the legend adhered thereto. A particularly preferred method of manufacturing such signs is claimed and described in British Patent Specification No. 2,005,596.

In a particularly preferred embodiment the extruded section comprises formations on the facing surfaces of the two flanges which enable two plates to be inserted and held in positions parallel to and spaced from the central web. The first may be a sign plate bearing a legend and the other, the more remote from the central web, may be a transparent or translucent cover plate. Alternatively, an opaque cover plate extending only part way, e.g. half way along the length of the piece of extrusion may be mounted in the channel more remote from the central web and may be slidable in the channel to expose or cover a legend on the sign plate between it and the central web.

Extruded sign components according to the present invention may be used singly in either of the two ways indicated above. They are also particularly well adapted for use in pairs. Thus for example two identical sections may be assembled with their flanges and accordingly hollow sides facing one another. Alternatively, the two channel sections may be welded or otherwise secured back to back and the same or different signs inserted into each of the frames thereby formed.

In order to use the extruded sections to the best advantage, a number of accessories may be provided. For example base members may be provided having projections thereon over which the extruded sections may be clipped with the two flanges resiliently engaging formations on the base member in the fashion of a spring clip. In a particularly preferred embodiment, the outwardly facing surfaces of the two flanges bear a key configuration groove, i.e. a groove of wider cross section more remote from the external surface of the flange than nearer to it. The cross section may be a dovetail or other suitable key configuration. Preferably such configuration is located substantially halfway across the flange in order that two such configurations lie the same distance apart when two extruded sections are placed back to back as when they are placed front to front. Simple extruded key pieces may be used in connection with such key configurations to link two extruded sections together.

A further way in which the sign unit may be used is as a receiving unit for a tile holder, into which tile holder tiles bearing, e.g. letters or numbers may be interchangeably inserted. This way of using the unit is useful where there is a need to vary sign information.

The extruded sign unit may be made of any suitable material. Aluminum alloy extrusions are preferred, though rigid plastics can be used also.

The invention is illustrated by way of example in the accompanying drawings, in which.

Figure 12:
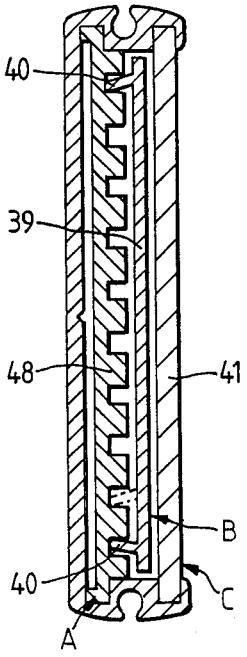
FIGS. 10, 11 and 12 are cross sections through signs made using the third embodiment.
Figure 9:
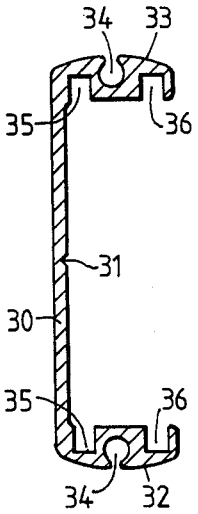
FIG. 9 is a cross section through a third embodiment.
Figure 18:
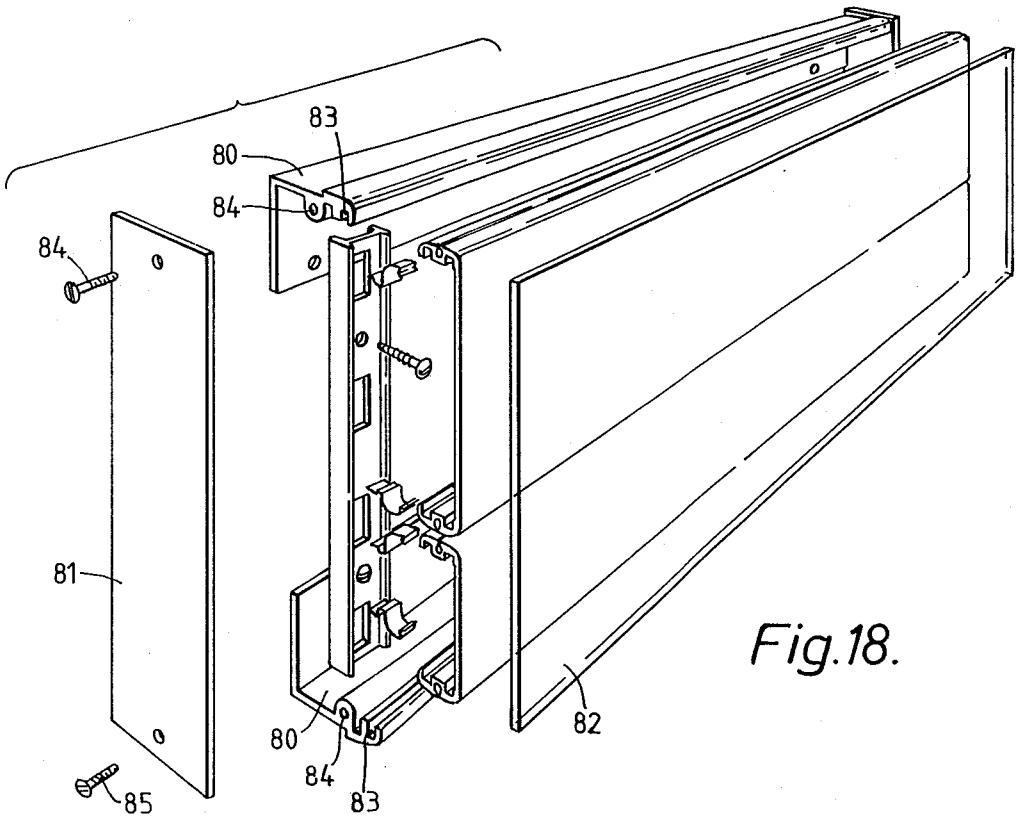
Figure 19:
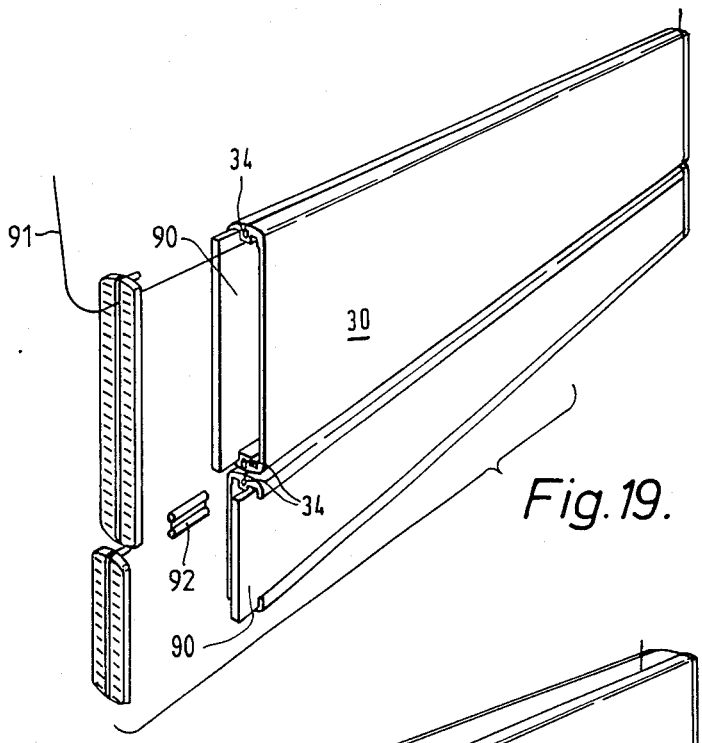
Figure 20:
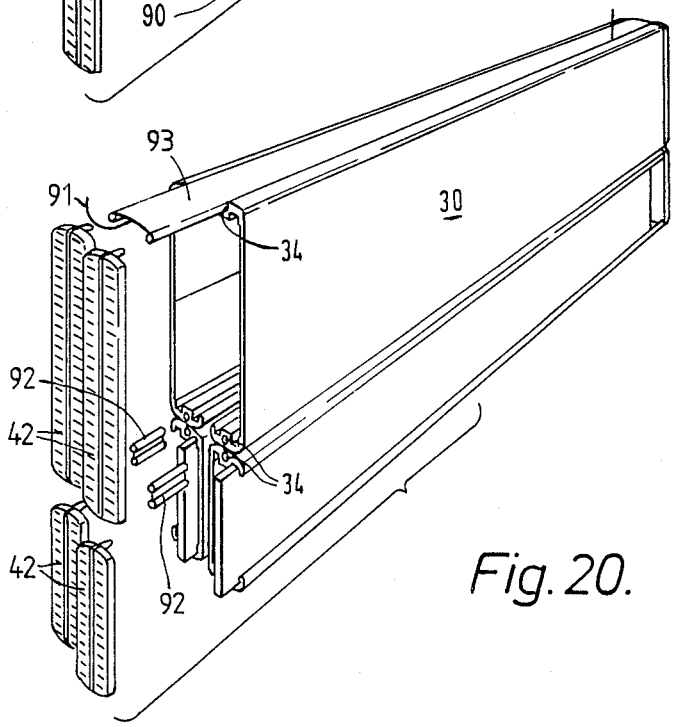
Figure 21:
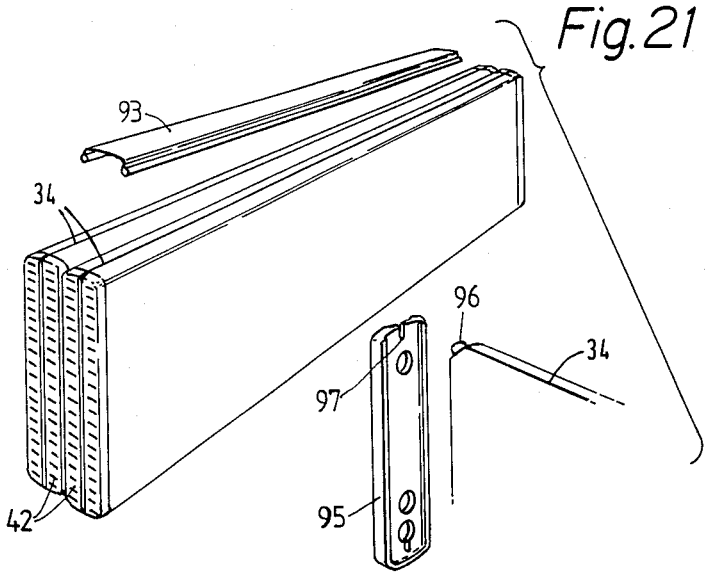

FIGS. 13, 14, 15, 16 and 17 shown in perspective part exploded view further types of sign made using the third embodiment and using a variety of accessory pieces;

FIG. 18 shows how a sign made up using the extrusions shown in FIGS. 9 and 12 may be enclosed in an outer frame;

FIGS. 19 and 20 show in exploded view hanging sign configurations;

FIG. 21 shows a flag sign configuration, and

Figure 22:
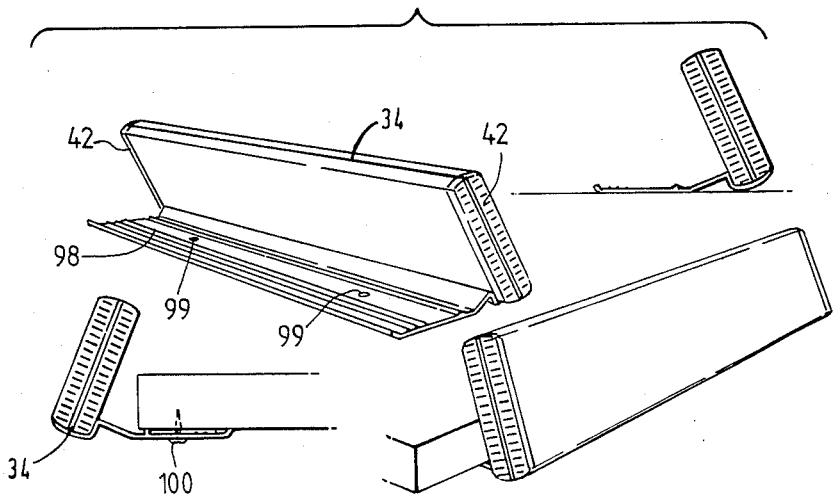

FIG. 22 shows a desk bar.

Figure 1:
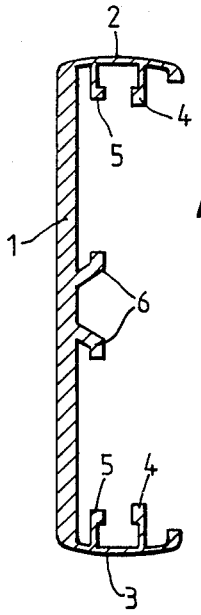
FIG. 1 is a cross section of an extruded component according to the invention.
Figure 6:
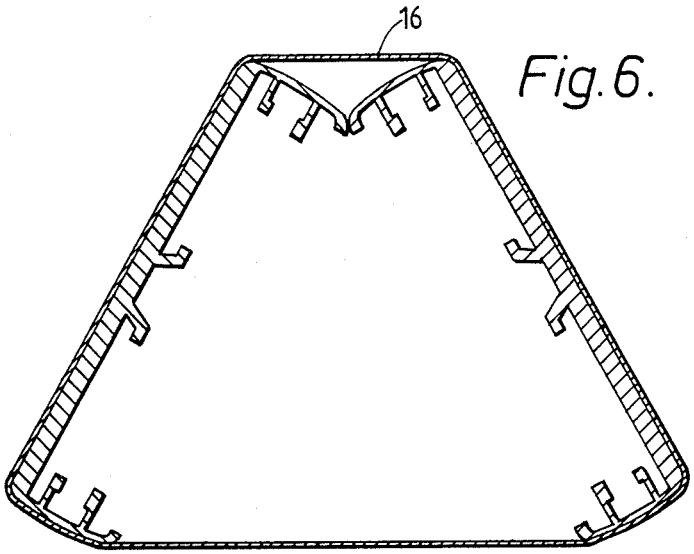
FIG. 6 is a cross section through a desk bar again using the component according to the invention.
Figure 7:
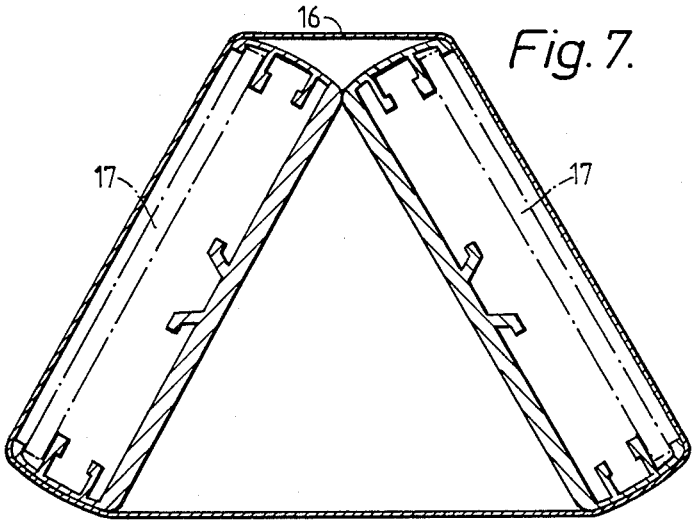
FIG. 7 is a cross section through an alternative form of desk bar.
Figure 8:
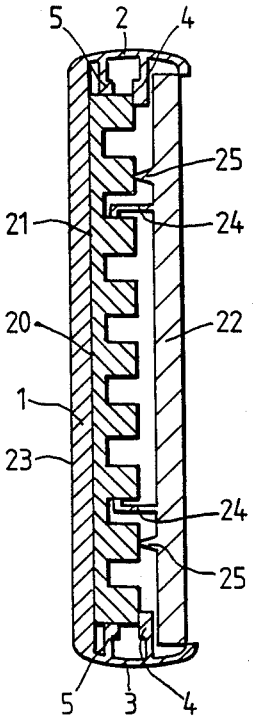
FIG. 8 is a cross section of an alternative embodiment showing its use as a component of a variable sign.

Referring to FIGS. 1 to 8 of the drawings, each shows in cross section one or more extruded components, as shown in FIGS. 1 or 8. The extruded component consists of a central web 1 and two flanges 2, 3. Moulded integrally with flanges 2, 3 are two upstanding ribs. viz. an outer rib 4 and an inner rib 5. In the case of FIGS. 1 to 7, moulded integrally with central web 1 is a pair of ribs 6 defining the centre of the web and consituting a guide for attachment of the extruded section. In the case of FIG. 8, a central groove 20 is formed on web 1.

Figure 2:
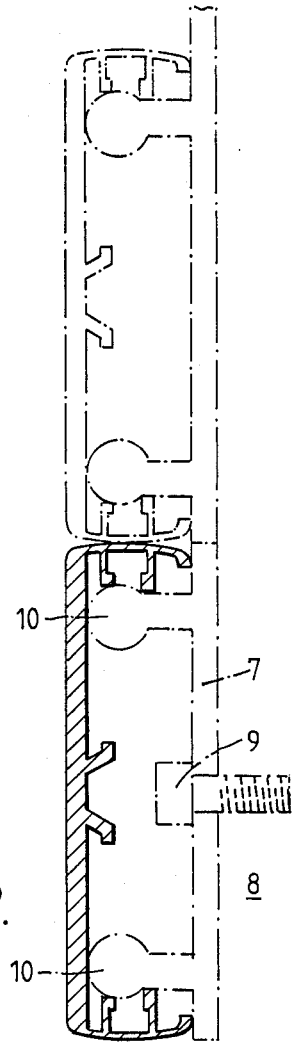
FIG. 2 is a cross section of the sign component according to the invention mounted on a wall in use as a first surface sign.

Not all of the ribs 4, 5 and 6 are used in all sign applications. Thus for example FIG. 2 shows the use of ribs 4 and 5 to clip the extruded section over a bracket 7 itself fixed to a fixed structure 8 such as a wall or noticeboard by means of a bolt 9. Component 7 may likewise be made from an extruded plastics section or it may be a moulded plastics unit. Ribs 4 and 5 clip resiliently on to beads 10 on component 7. As shown in FIG. 2, two or more extruded sections may be located side by side.

Figure 3:
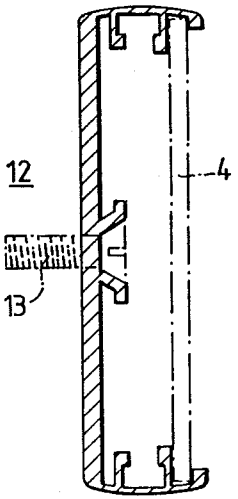
FIG. 3 is a similar view showing the component of the invention used as a sign frame with a sub-surface sign.

FIG. 3 shows the extruded section mounted on a wall 12 by means of a screw 13 the head of which fits between ribs 6. A sign plate 14 is spring-clipped between flanges 2 and 3 and held vertical by ribs 4.

Figure 5:
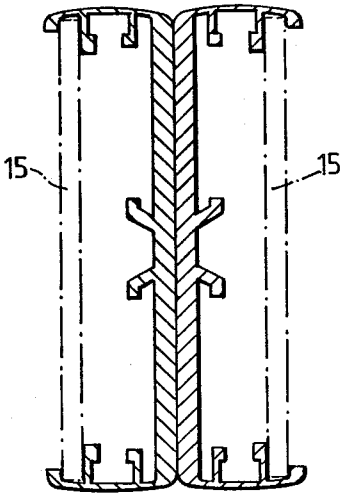
FIG. 5 is a cross section through an alternative form of flag sign.
Figure 4:
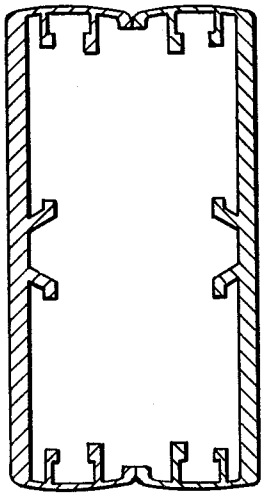
FIG. 4 is a section through a flag sign formed using two components according to the invention.

FIGS. 4 and 5 double sided sign units formed by two extrusions. In the case where webs 1 are adjacent, each extrusion has a sign sheet 15 clipped into it. In both cases a generally rectangular plastics end cap may be used to unite the two extrusions and hold them together.

FIGS. 6 and 7 show desk boards, where two extrusions are held between two plastics end caps 16 each of which consists of a base of the shape of an equilateral triangle with its corners cut off and a side wall of hexagonal shape with three longer sides and three shorter. In the desk bar of FIG. 7, the legend is on its two clipped-in sign sheets 17.

FIG. 8 shows a sign consisting of three components, viz. a sign unit according to the invention, a tile holder insert 21 and a set of tiles 22. The holder 21 fits in place between ribs 4 and web 1 and has a grooved face with grooves 23. Interchangeable tiles 22 have rearward resilient ribs 24 on one face which are dimensioned to fit into grooves 23 and bear against the flanks of grooves 23 to hold tile 22 in place as illustrated. Two associated ribs 25 abut the surface of holder 21 to ensure that the plane of tile 22 is parallel to the plan of web 1. Letters, numbers or other symbols are e.g. printed on to the face of each tile 22 opposite ribs 24 and 25.

Figure 10:
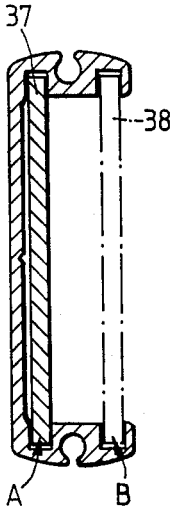
Figure 11:
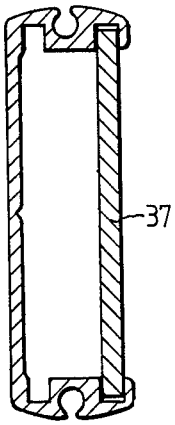
Figure 13:
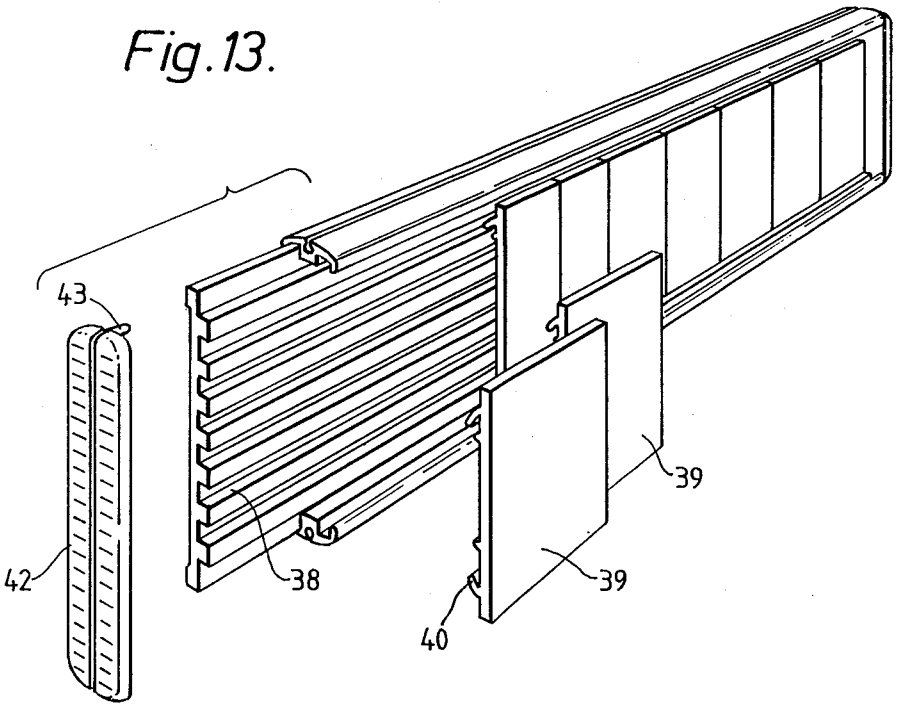

Referring now to FIGS. 9 to 22, these show the use of an extruded section of different configuration. As is clear from FIG. 9 the extruded configuration consists of a central web 30 having a centre groove 31 formed on one side thereof and having two flanges 32, 33 extending each side. Each flange has an external key configuration groove 34 and two internal facing grooves 35 to closer to web 30 and 36 more remote therefrom. Plates such as sign panels 37 or translucent protective sheets 38 may be inserted into the pairs of grooves as shown in FIGS. 10 and 11. Also a ribbed plate 48 may be inserted between grooves 35 which may receive letter-carrying tiles 39 each of which has a pair of resilient prongs 40 on its rear face which is engaged in the grooves in plate 48. To complete such a sign which is shown in detail in FIG. 12 and in exploded form in FIG. 13 a transparent plate 41 may be fitted into grooves 36. The ends of such a sign may be finished by injection moulded plastics end members 42 which have a pair of prongs 43 moulded thereon which are a press-fit in grooves 34.

Figure 14:
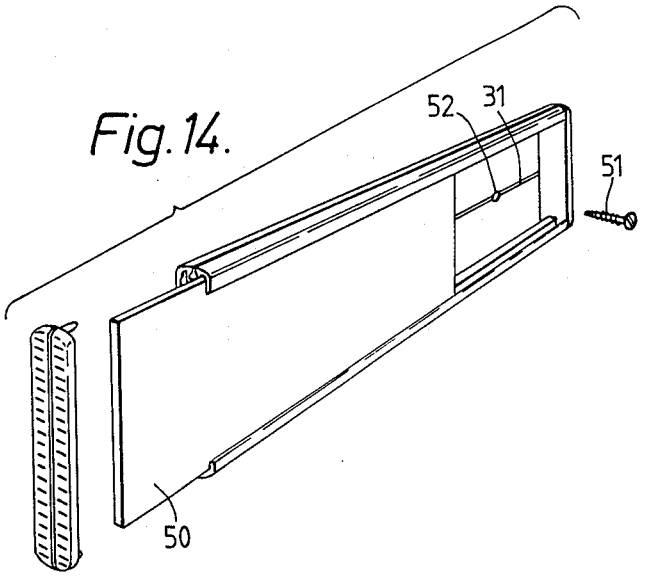

FIG. 14 shows a simple form of sign consisting of a single-piece extrusion carrying a sign sheet 50 the sign being finished with end plates 42. The sign may be affixed to e.g. a wall using screws 51 which pass through holes 52 drilled in the centre of the web 30. The groove 31 ensures that both holes are drilled centrally.

Figure 15:
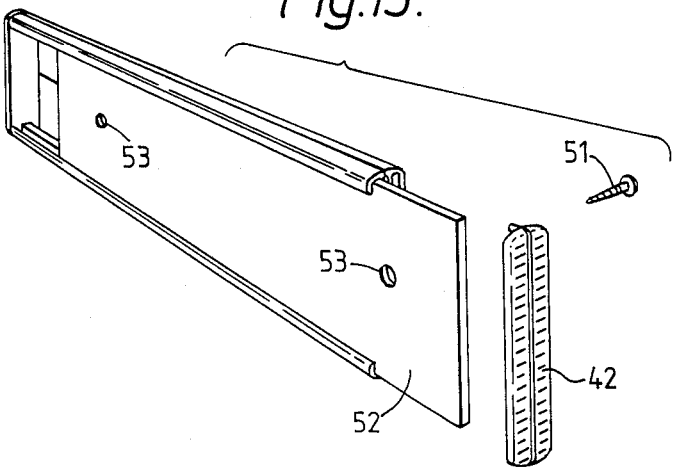

FIG. 15 shows an alternative approach where the flat outer face of web 30 is used for the sign. In this case, a mounting panel 52 having a pair of holes 53, through which screws pass, is mounted on a wall or like with suitable spacing means between plate 52 and the wall. The extrusion is then slid on with its flat face outwards and end caps 42 press fitted in the usual way.

Figure 16:
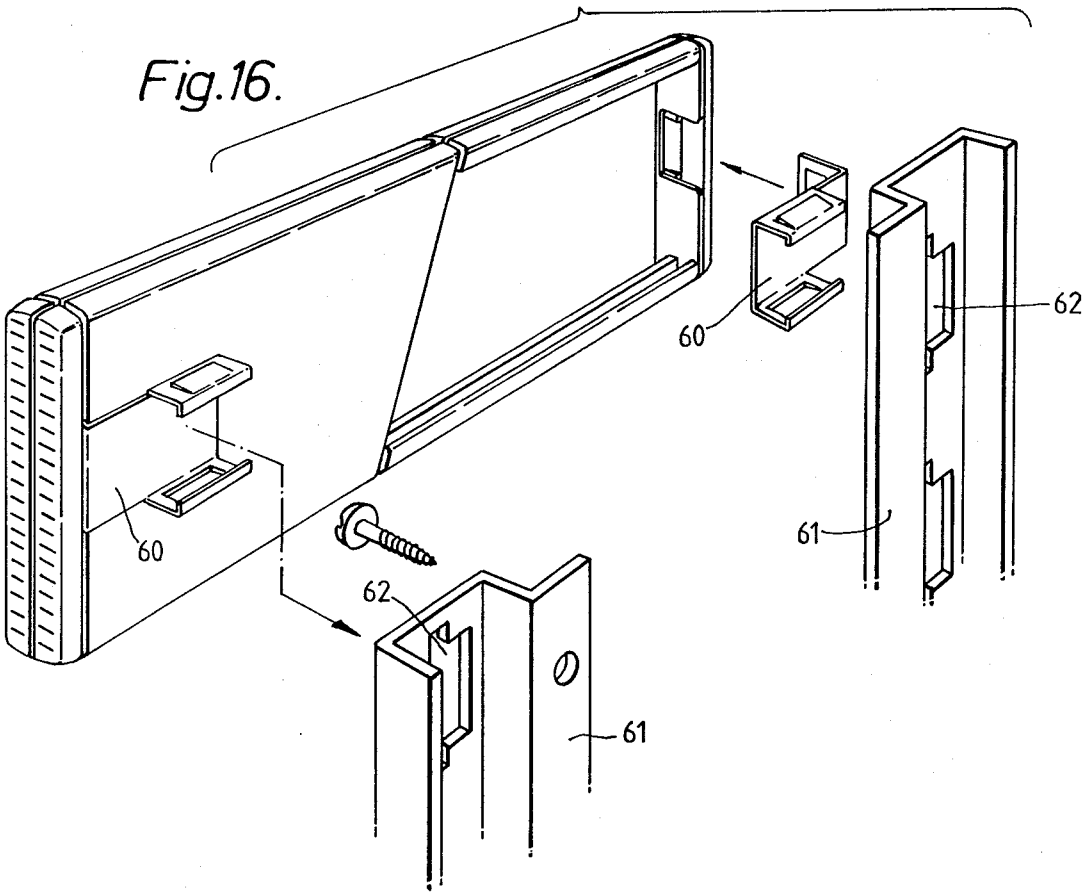

FIG. 16 shows in exploded view how an array of extruded sections may be placed on a wall fitted by means of simple bent flat metal clips 60 into sections 61 which are mounted e.g. on a wall and which have apertures 62 into which the clips 60 are a spring fit.

Figure 17:
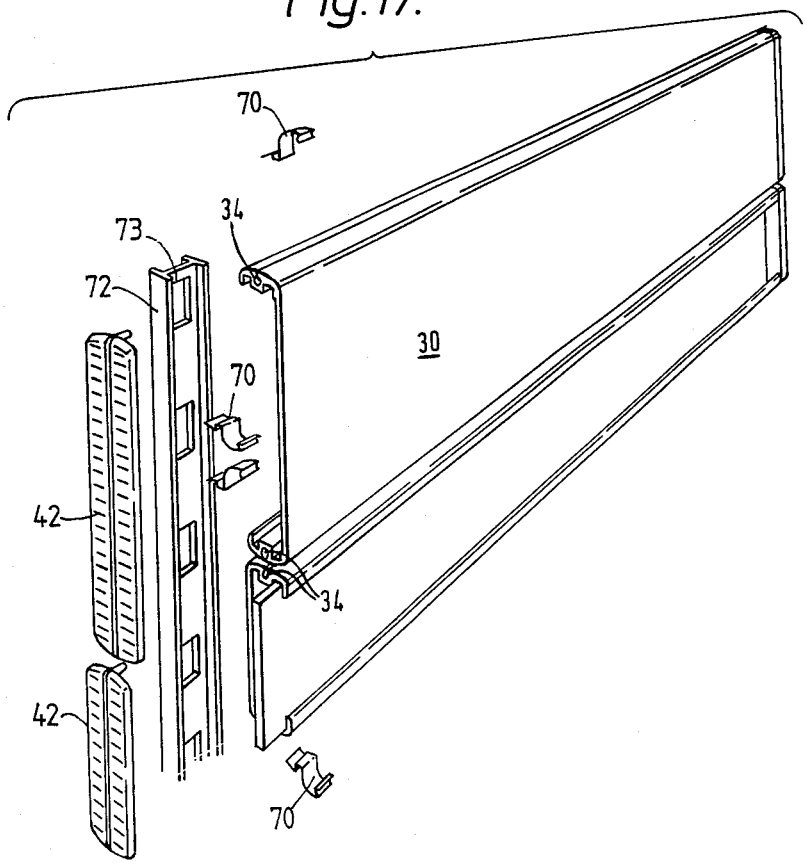

An alternative fixture system using clips 70 which fit into grooves 34 is shown in FIG. 17. All the clips 70 are identical and are made of spring steel. They fit into successive slots in a section, for example, a metal section 72, the edge of each clip 70 fitting into an edge of a rectangular aperture 73 punched in the central web of member 72. End caps 42 fit on to the ends of the extrusions by means of prongs as described above.

FIG. 18 shows a sign in accordance with FIG. 17 and protected by an exterior frame consisting of top and bottom members 80, two end plates 81 and a transparent front panel 82 which fits in opposed grooves 83 on members 80. Members 80 contain holes 84 at their ends into which fixing screws 85 fit to hold panel 81 in place. This sort of signage construction is of particular value in large directory signs, e.g. for use in the entrance lobbies of office blocks.

FIG. 19 shows how the sign consisting of a section of extrusion and a sign plate 90 can be suspended by means of a wire 91 which passes through the interior of the section. A small extruded link piece 92 fits in two grooves 34 to link two adjacent extruded sections together. FIG. 20 shows a more substantial sign construction, again suspended by a wire 91 which hangs the sign up via a further extruded section 93 which engages in two grooves 34 of two side by side by side lying extruded sections, the web 30 of each of which bears a desired legend. The ends of these hanging signs are closed as previously by end caps 42.

A flag sign is shown in FIG. 21 consisting of two extrusion sections, an extrusion linking section 93, two end caps 42 and mounting bracket 95, e.g. formed of plastics by impact moulding. The bracket 95 is placed in a wall and the section hung e.g. by means of a screw 96 which is driven into groove 34 from the end and which fits into a slot 97 on clip 95.

Finally, FIG. 22 shows the use of a further simple extruded section 98 which has a bead which can slide into groove 34. A desk bar can simply be made out of an extruded section, two end caps 42 and a suitable legend-bearing sign plate. Extrusion 98 may have two holes, 99, bored in it through which screws 100 may pass to attach a desk bar to a desk.

We claim:

1. A reversible multipurpose sign unit comprising (a) a flat central web (b) a pair of flanges joined to and extending from each of the two edges of said central web, both of said flanges lying on the same side of the plane of the central web, said flanges and said central web having a generally elongated C-shaped cross section, (c) each of said flanges having an inner surface and an outer surface, each of said inner surfaces facing the other, (d) a flat outer surface of the web on the side opposite the flanges which outer web surface is adapted to receive a first sign legend, (e) a first pair of inward facing ribs located on th inner surface of each of the two flanges and spaced apart from the inner surface of said web, (f) a second pair of inward facing ribs located on the inner surface of each of the flanges and positioned between said first pair of ribs and the inner web surface (g) said first and second pair of ribs standing parallel to each other and projecting away from the inner flange surface on which said ribs are mounted, said first and second ribs defining between them facing grooves, said grooves being adapted to receive a first interchangeable flat sign plate, and hold said flat sign plate in a fixed position parallel to and spaced from the central web and entirely within the outside edges of said C-shaped cross section, and said second ribs also defining facing grooves, said grooves being adapted to receive a second interchangeable flat sign in a fixed position parallel to said first sign plate and between said first sign plate and said central web whereby the outer web surface and said flat plates of said sign unit are parallel and can all be used as a sign surface and said sign unit can be used either way round.

2. The sign unit of claim 1 wherein at least one of the flanges and the ribs are sufficiently resilient to enable the sign unit to be spring clipped over a supporting means.

3. A sign comprising at least one sign unit according to claim 1 and having a sign legend applied to the surface of the central web remote from the flanges.

4. A sign consisting of at least one sign unit in accordance with claim 1 together with at least one sign plate held between the two flanges of the sign unit(s).

5. The sign of claim 4 and including end pieces press fitted into the ends of the sign unit(s).

6. The sign of claim 4 and including a plurality of sign units each resiliently clipped to at least one supporting means.

7. A reversible multi-purpose sign unit comprising (a) a unitary extruded section including a flat central web and two flanges, the flanges extending from the two edges of the central web and lying on the same side of the plane of the central web, the extrusion having a generally elongated C shaped cross section (b) a flat outer surface of the web on the side opposite the flanges (c) recessed grooves located on the facing surfaces of the two flanges, said grooves extending along the inner surface of said flanges and parallel to the inner surface of said central web (d) a flat plate held within said grooves and in a position parallel to and spaced apart from the central web and (e) means attached to at least one flat surface on said multi-purpose sign unit for attaching said unit to a wall.

8. In combination, a reversible multi-purpose sign unit comprising a unitary moulded, one-piece, extruded formation, said formation having a generally elongated C-shape in cross-section and including a flat central web, two flanges extending from a surface of the central web and lying both on the same side of the plane of the central web, and an inner and an outer rib moulded integrally with each flange and extending inwardly toward an opposite flange, the inner and outer rib of each flange being generally in parallel and respectively positioned proximately and distally to the central web, the inner rib of each flange being shorter than the outer rib of the same flange, the flat central web having a flat surface opposite to that from which the flanges extend which is adapted to receive a legend, at least one flange and the outer rib of said at least one flange being resiliently formed; and a mounting bracket adaptable for use i supporting the sign unit, the mounting bracket including a flat back plate and a pair of legs extending from a surface of the back plate and lying both on the same side of the plane of the back plate, each leg being free standing and including a bulbous formation at an end thereof to allow the mounting bracket to engage cooperatingly and secure the sign unit thereto.

9. The reversible sign unit of claim 1 wherein the ribs on the facing surfaces of the two flanges consist of two upstanding ribs molded integrally with each flange defining two pairs of grooves, whereby a first flat sign plate may be received between the flanges engaged in a first one of said pairs of grooves and held at a relatively lesser distance spaced apart from said central web and a second flat sign plate may be received between the flanges engaged in the second pair of said grooves, spaced apart from said first sign plate, parallel to said central web, and held at a relatively greater distance from said central web than said first flat sign plate.

10. A reversible multi-purpose sign unit comprising (a) a unitary extruded section formed of a flat central web and two flanges, the flanges extending from the two edges of the central web and lying both on the same side of the plane of the central web, the extrusion having a generally elongated c-shape in cross section, (b) a flat outer surface of the web on the side opposite the flanges which surface is adapted to receive a legend and (c) formations on the facing surfaces of the two flanges which formations are adapted to receive an interchangeable flat sign plate and hold said flat sign plate in a position parallel to and spaced from the central web and within the outside edges of said c-shape cross section, whereby the flat outer surface and said flat plate of said sign are parallel and can both be used as a signed surface, said sign unit can be used either way around and the outwardly facing face of each of the flanges has a key configuration groove therein.

11. A reversible multi-purpose sign unit comprising (a) a unitary extruded section formed of a flat central web and two flanges, the flanges extending from the two edges of the central web and lying both on the same side of the plane of the central web, the extrusion having a generally elongated c-shape in cross section, (b) a flat outer surface of the web on the side opposite the flanges which surface is adapted to receive a legend and (c) formations on the facing surfaces of the two flanges which formations are adapted to receive an interchangeable flat sign plate and hold said flat sign plate in a position parallel to and spaced from the central web and within the outside edges of said c-shape cross section, whereby the flat outer surface and said flat plate of said sign are parallel and can both be used as a signed surface, said sign unit can be used either way around and wherein the grooves are located halfway up the unit when the flat outer surface of the unit is in a horizontal plane.

12. A reversible multi-purpose sign unit comprising (a) a unitary extruded section formed of a flat central web and two flanges, the flanges extending from the two edges of the central web and lying both on the same side of the plane of the central web, the extrusion having a generally elongated c-shape in cross section, (b) a flat outer surface of the web on the side opposite the flanges which surface is adapted to receive a legend and (c) formations on the facing surfaces of the two flanges which formations are adapted to receive an interchangeable flat sign plate and hold said flat sign plate in a position parallel to and spaced from the central web and within the outside edges of said c-shape cross section, whereby the flat outer surface and said flat plate of said sign are parallel and can both be used as a sign surface, and said sign unit can be used either way around and (d) a pair of ribs molded integrally within said central web and located on the flat inner surface of the web, said ribs projecting inwardly toward said flanges and away from said flat central web.

* * * * *